United States Patent [19]

Guillemette

[11] 4,185,911

[45] Jan. 29, 1980

[54] PHOTOGRAPHIC ENLARGEMENT AND DEVELOPMENT APPARATUS

[76] Inventor: Réjean Guillemette, 715 Réal St., La Tuque, Québec, Canada, G9X 2S4

[21] Appl. No.: 928,947

[22] Filed: Jul. 28, 1978

Related U.S. Application Data

[63] Continuation-in-part of Ser. No. 756,633, Jan. 4, 1977, abandoned.

[30] Foreign Application Priority Data

Jul. 14, 1976 [GB] United Kingdom ..... 29401/76

[51] Int. Cl.[2] ..... G03D 13/04

[52] U.S. Cl. ..... 355/27; 354/331; 354/335; 354/343; 354/346

[58] Field of Search ..... 354/317, 318, 323, 324, 354/325, 326, 331, 333, 334, 335, 336, 337, 340, 342, 343, 344, 345, 346; 248/221.1, 221.2; 355/27, 44

[56] References Cited

U.S. PATENT DOCUMENTS

| | | | |
|---|---|---|---|
| 1,089,916 | 3/1914 | Fisher | 354/345 |
| 2,161,229 | 6/1939 | Milne | 354/335 |
| 2,166,387 | 7/1939 | Bassin | 354/343 |
| 2,964,995 | 12/1960 | Tondreau | 355/44 |
| 3,067,667 | 12/1962 | Krehbiel | 354/334 |
| 3,091,423 | 5/1963 | Butterworth | 248/221.2 |
| 3,166,999 | 1/1965 | Dement | 354/325 |
| 3,316,827 | 5/1967 | Hill | 354/343 |
| 3,719,133 | 3/1973 | Haracz | 354/317 |
| 3,721,175 | 3/1973 | Needleman | 354/317 |
| 3,765,758 | 10/1973 | Jackson et al. | 355/44 |

FOREIGN PATENT DOCUMENTS

| | | | |
|---|---|---|---|
| 672465 | 2/1939 | Fed. Rep. of Germany | 354/340 |
| 951212 | 3/1964 | United Kingdom | 354/340 |

*Primary Examiner*—L. T. Hix
*Assistant Examiner*—Alan Mathews

[57] ABSTRACT

A device for enlargement and development of photographs and particularly adapted to efficiently produce posters in a conventional darkroom and to efficiently develop photographs of different sizes. This device includes a posting pegboard, pegs, and clips to hold photographic sheet material in a single vertical position while producing an enlarged print or poster thereon, developing the print, and rinsing the developed print. A sink is operatively associated to the posting board and includes a trough underlying the latter to collect the drips from the wet prints. The sink includes transverse channels with dividing partitions tightly fitting in these channels and separating the sink into a plurality of basins for development of photographic prints. A lattice rests on a peripheral flange of the sink to form a two-level arrangement with the sink for more versatile handling of prints and use of the device.

4 Claims, 6 Drawing Figures

PHOTOGRAPHIC ENLARGEMENT AND DEVELOPMENT APPARATUS

This application is a continuation in part application of application Ser. No. 756,633 filed Jan. 4, 1977, now abandoned.

This invention relates to photographic enlargement and development equipment, and more particularly, to a photographic enlargement and development device.

With the increased popularity of posters, the darkroom of an ordinary photographic studio is faced with a space problem and is not equipped to efficiently process such product. Consequently, an odd procedure had to be used to enlarge and develop the posters. So far, the enlargement process to produce a poster included rotation of the enlarger head around its supporting post and placing the enlarger on the corner of a table or counter to project on the photographic paper laid on the floor of the darkroom. Such procedure is found disadvantageous since it requires substantial floor space and time and impedes normal use of the darkroom. The development procedure which has been used so far for the posters is also time consuming and results in wastage of energy and chemicals. So far, the poster has generally been developed by rolling the poster, inserting it in a tube with diluted development chemicals, shaking the closed tube to produce even development, and rinsing and drying the developed poster using any available means such as for instance in a bathtub and on a clothesline respectively. Besides, such odd enlargement and development procedure gives poor results such as poor quality and an excessively costly photographic reproduction or poster.

The development of photographs of different sizes has always been a problem in a conventional darkroom since the development chemicals are rather expensive and the amounts used must be kept as low as possible. So far, this has been done by using trays of many different sizes in relation to the different sizes of the prints so that no excess of development chemicals is wasted.

It is a general object of the present invention to provide a photographic enlargement and development device for a conventional darkroom which substantially avoids the above mentioned disadvantages.

It is another general object of the present invention to provide a photographic enlargement and development device which is particularly adapted for efficient production of posters or other relatively large photographs.

It is a more specific object of the present invention to provide a photographic enlargement and development device which saves space, time, and energy for the production of posters in a conventional darkroom and which results in a less expensive enlargement and development procedures.

It is a still more specific object of the present invention to provide a photographic enlargement and development device which is adapted to process a poster completely from enlargement to drying of the development print while advantageously holding the poster in a single vertical position.

It is a specific object of the present invention to provide a photographic enlargement and development device including a posting board and an underlying trough to hold a photographic sheet material in a single vertical position on the posting board during enlargement, development, and rinsing with the trough collecting the drips from the developed print, and the development chemicals and rinsing being done with a roller of the paint roller type.

It is another specific object of the present invention to provide a photographic enlargement and development device which forms the complete basic equipment for the wet side of a darkroom and which includes a sink and lattice allowing functional step-by-step development of the photographic prints and practical posting of the latter for drying and even development thereof with a roller of the paint roller type.

The above and other objects and advantages of the present invention will be better understood with reference to the following detailed description of preferred embodiments thereof, which are illustrated, by way of examples only, in the accompanying drawings, in which.

Figure 1:
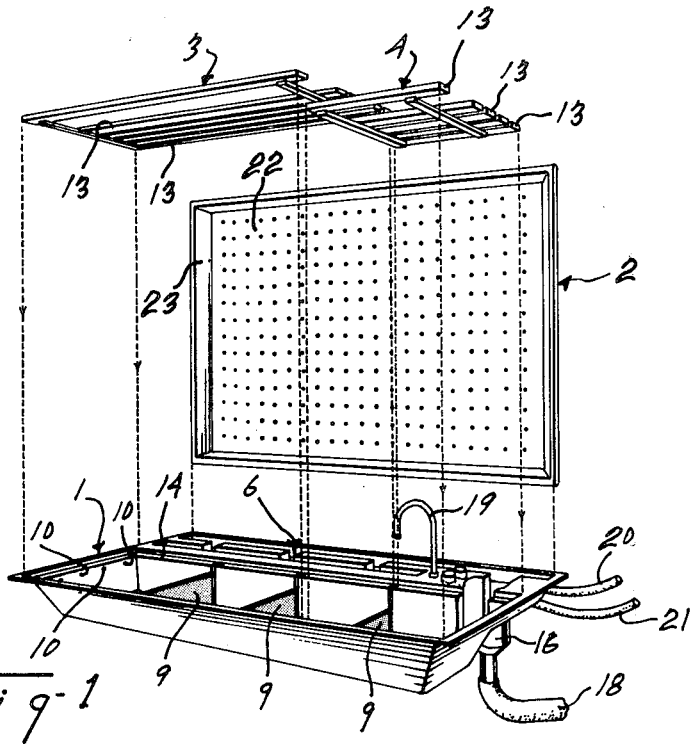
FIG. 1 is an exploded perspective view of a photographic enlargement and development device according to the present invention.

The photographic enlargement and development device illustrated in FIGS. 1, 3, 4, 5, and 6 includes a sink 1, a posting pegboard 2, a pair of lattices 3 and 4.

The sink 1 is integrally molded to form an elongated rectangular and shallow body of predetermined width and length to allow reaching by hand all corners thereof by the operator sitting or standing in front of it. This sink 1 thus forms a main elongated cavity 5 and a relatively narrow cavity 6, both extending substantially from end to end of the sink. The wider cavity 5 extends forward of the cavity 6 and defines a main basin area having a bottom 7 sloping down gently toward the right end of the sink 1. Channels are formed in the bottom 7 and extend lengthwise transversely across the cavity 5 and are laterally spaced apart from each other along the sink. A rubber strip seal 8 is engaged in each channel. A divider 9, of acid-resistant material, such as plastic or glass, is engaged edgewise in each channel in sealed engagement with each rubber strip seal 8 and thus forms a fluid-tight partition. These dividing partitions 9 are selectively removable and divide the main cavity 5 into a series of basins juxtaposed lengthwise of the sink. As may be seen in FIG. 1 and best in FIG. 4, the dividers 9 are arranged in cascade down toward the right end of the sink 1, thus defining a downstream direction toward the right end. At the left end or upstream end of the main cavity, there are spray nozzle outlets 10 formed in the end wall of the sink and a manifold 11 interconnecting these outlets 10. This manifold 11 is connected in any appropriate way to a water supply system to eject rinsing sprays of water through the outlets 10. Elongated cavities or depressions 12 are formed in the bottom 7 and in each basin defined by the dividers 9. The lattices 3 and 4 are made of lath 13 and are formed with a gap along the front edge thereof. The lattices 3 and 4 operatively rest on a peripheral flange or shoulder 14 extending around the main cavity 5.

The narrow elongated cavity 6 is also sloping down toward the right end or downstream end of the sink and forms a trough whose function will be better defined later. A system of draining channels 15 drains itself into the trough 6. A drain 16 is connected to the sink 1 at the downstream end of the trough 6 and main cavity 5. The trough and this main cavity laterally communicate with each other through a transverse drain channel 17 and the drain 16 is laterally offset from the main cavity such as not to interfere with the photographic prints placed in the adjacent basin downstream of the last divider 9. The drain 16 is connected to a drain system by a pipe 18, in any conventional way. A goose neck water supply nozzle 19 is positioned adjacent the drain 16 to provide a water supply for the sink 1. The goose neck nozzle 19 is conventionally connected to hot and cold water lines and valves and to a water saving and recirculating system, as used in the present automatic clothes washers. This recirculation system includes a pair of hoses 20 and 21 communicating with an appropriate basin or reservoir for the recirculated liquid.

The posting pegboard 2 is integrally formed with a rectangular panel 22 and peripheral flange 23. The latter is inclined edgewise outward and away from the plane defined by panel 22. This panel 22 is formed with rows and columns of cavitites 24; into each is inserted a flexible material body or plug 25. Each plug 25 is formed with a central aperture to frictionally insert a peg, or the like shank member therein.

Figure 6:
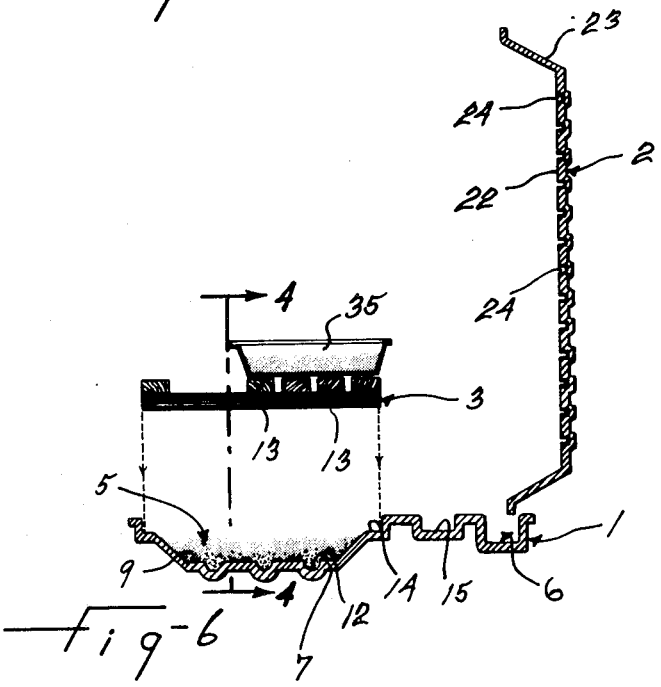
FIG. 6 is a transverse cross-sectional view of the device as seen along line 6—6 in FIG. 4 and including a a corresponding cross-section of the posting pegboard.

A plurality of pegs 26 are operatively associated to the pegboard 2; at least 4 pegs are required. Each peg 26 includes a shank portion 27 and a grip portion 28. The shank portion 27 is adapted to frictionally fit in a plug 25. A string 29 is tied at one end to the shank 27 and at the other end to a clip 30 which is adapted to clip the edge of a photographic print or sheet material, not shown. The clip 30 simply includes two members 31 and 32 which are pivoted to each other and biased toward a clamping position relative to each other. The posting board 2 is operatively arranged edgewise upright in overlying relationship with the trough 6, as seen in FIG. 6.

Figure 2:
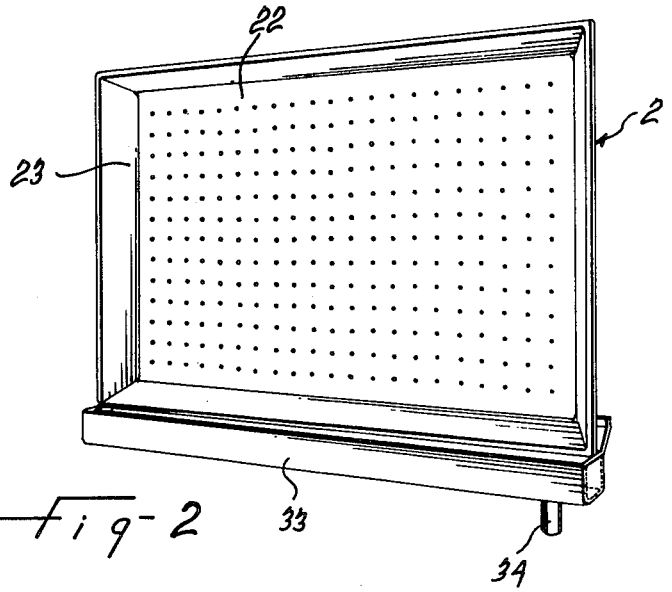
FIG. 2 is a perspective view of a posting board and trough assembly according to another embodiment of the present invention.
Figure 3:
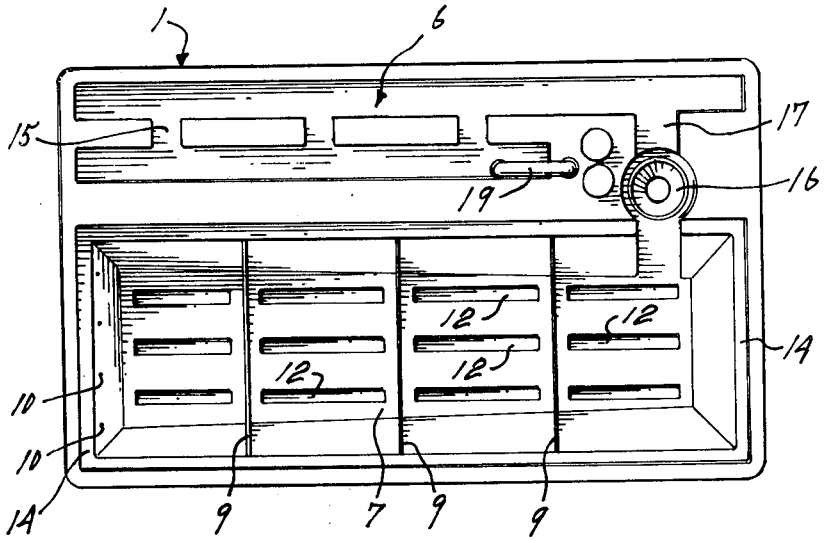
FIG. 3 is a top view of a sink forming part of the device of FIG. 1.
Figure 4:
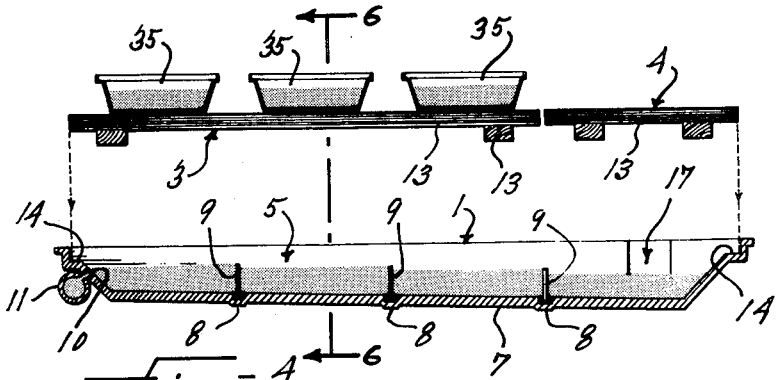
FIG. 4 is a longitudinal cross-sectional view as seen along line 4—4 in FIG. 6.
Figure 5:
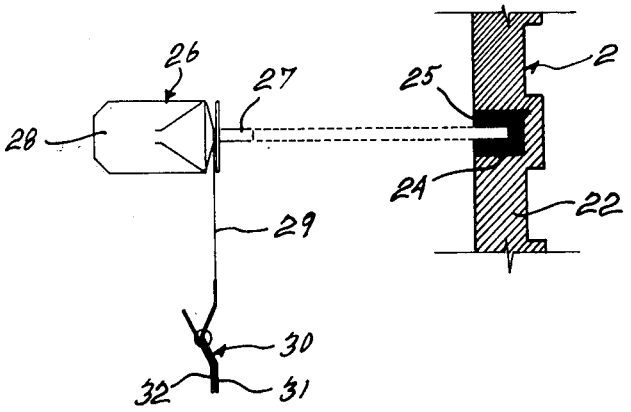
FIG. 5 is a detailed view of a peg and clip arrangement in operative engagement in a hole of the pegboard.

In the embodiment of FIG. 2, the posting board 2 has no holes and is used independently of the sink 1 and to allow this, it is mounted on a separate semi-tubular trough member 33 provided with a drain 34.

The development of prints may be made solely in the basins defined in the sink 1 by the dividers 9 or the development may be made serially and step by step in trays 35 aligned on the lattices 3 and 4 with the rinsing being made in the afore-mentioned basins. The predetermined wider space in each lattice 3 and 4 allows access to these basins, better shown in FIG. 6. The prints or photographs may be easily picked up on the bottom 7 of the sink 1 due to the depressions 12 which allow easy pinching of the edge thereof. One or more dividers 9 may be removed to process larger prints, such as posters.

Drying of a rinsed and developed photograph, or poster, is done by holding the latter stretched against the board 2 by clips 30 holding the edges of the photograph, or poster, and the pegs 26 holding taut the strings 29 and, thus, also the photographic print or poster. Development and fixing of the largest photographic prints and posters may be made while the latter are so posted against the board. This is done by wetting the same with a brush of the paint roller brush type using a developer liquid and then a fixing liquid and rinsing after each treatment by means of a rubber hose equipped with a shower at one end and to the goose neck nozzle at the other end. The drips of development and fixing chemicals and/or rinsing water are collected by the trough 6 and the drain 16.

The posting board 2 may also be used to enlarge a photographic print and produce a poster. In short, this is done by placing the required photographic sheet material against the board and holding it by glue or with clips 30, tilting the head of an enlarger to project the desired image against the unexposed photographic sheet material, effecting the exposure, and thereafter developing and rinsing as afore-described without at all moving the print by hand.

Since the board 2 has a flat outer surface, the image to be printed can first be projected directly on the board 2 for prefocusing and cropping of the image on the board. Thereafter, the unexposed photographic sheet material is secured flat on the board, as noted above, and exposed and developed as mentioned hereinabove. To facilitate cropping, frames of different standard sizes are drawn with pressure-sensitive black tape on the outer face of the board.

I claim:

1. A photographic enlargement and development device comprising an upstanding posting board dimensioned to accommodate a relatively large photographic paper against one face thereof and defining a bottom edge, clips fixable to said posting board and removably affixing photographic print material against said one face, a trough underlying said bottom edge and operatively collecting drip from any developed print posted wet against said one face, a sink unit having a drain, a main cavity defining a basin area, an elongated secondary cavity extending lengthwise along one side of said basin area, forming said trough, and communicating with said main cavity and said drain, and a lattice operatively resting on said sink unit, overlying said main cavity, forming a pervious support for resting photographic development accessories thereon, and having predetermined apertures therethrough allowing access to said main cavity.

2. A photographic enlargement and development device as defined in claim 1, wherein said main cavity extends longitudinally along said elongated secondary cavity, said cavities laterally communicate with said drain and with each other at one end of the cavities and removable partitions operatively extend longitudinally transverse to said cavities and selectively subdivide the main cavity into a plurality of adjacent basins, said sink unit forms an abutment flange peripherally extending around said basin area and operatively carrying said lattice, said main cavity has a bottom sloping down longitudinally thereof toward said one end, said removable partitions are arranged in cascade relative to each other down toward said one end, said bottom of the main cavity is formed with depressions therein, allowing pinching the edge of photographic prints on said bottom, said sink unit forms spraying nozzles in the upstream end of said main cavity, a hot and cold water supply is fixed to said sink unit adjacent said drain, and each of said posting board and sink unit constitutes a shallow body.

3. A photographic enlargement and development device as defined in claim 2, wherein said posting board constitutes a pegboard having a plurality of recesses extending in said one face thereof, and further including plastic plugs secured into said recesses and each defining a cavity opening at said one face, pegs frictionally engaging into the cavities defined by said plastic plugs, a string tied to each peg, a clip attached to the other end of the string, and said strings are windable around said pegs respectively for taut holding of said strings, clips, and the photographic paper held by the clips.

4. A photographic enlargement and development device as defined in claims 1, 2, or 3, wherein said posting board has a flat outer surface to allow pre-focusing and cropping of an illuminated image projected thereon and to then allow securing an unexposed photographic paper against said flat outer surface and exposing of said photographic paper with said image and to further allow development of the exposed photographic paper while the latter remains secured to said board.

* * * * *